US010012193B2

(12) United States Patent
Lakey

(10) Patent No.: US 10,012,193 B2
(45) Date of Patent: Jul. 3, 2018

(54) FUEL INJECTOR RAIL

(71) Applicant: DENSO International America, Inc., Southfield, MI (US)

(72) Inventor: Steven Lakey, Waterford, MI (US)

(73) Assignee: DENSO International America, Inc., Southfield, MI (US)

( * ) Notice: Subject to any disclaimer, the term of this patent is extended or adjusted under 35 U.S.C. 154(b) by 172 days.

(21) Appl. No.: 14/722,404

(22) Filed: May 27, 2015

(65) Prior Publication Data

US 2016/0348625 A1 Dec. 1, 2016

(51) Int. Cl.
*F02M 55/02* (2006.01)

(52) U.S. Cl.
CPC ..... *F02M 55/025* (2013.01)

(58) Field of Classification Search
CPC ..... F02M 61/14; F02M 55/025
USPC ..... 123/456, 470
See application file for complete search history.

(56) References Cited

U.S. PATENT DOCUMENTS

| | | | | |
|---|---|---|---|---|
| 6,374,809 | B2 * | 4/2002 | Satou | F02M 61/145 123/468 |
| 6,481,420 | B1 * | 11/2002 | Panasuk | F02M 55/004 123/469 |
| 6,637,411 | B2 * | 10/2003 | Makiyama | F02M 61/14 123/456 |
| 6,705,292 | B2 * | 3/2004 | Bugos | F02M 55/025 123/456 |
| 7,360,524 | B2 * | 4/2008 | Zdroik | F02M 55/005 123/469 |
| 7,556,022 | B1 * | 7/2009 | Doherty | F02M 55/004 123/456 |
| 8,398,328 | B2 * | 3/2013 | Marc | F02M 61/14 123/456 |
| 2001/0050073 | A1 * | 12/2001 | Engelmeyer | F02M 55/004 123/456 |
| 2004/0045532 | A1 * | 3/2004 | Minoura | F02M 55/004 123/470 |

* cited by examiner

*Primary Examiner* — Sizo Vilakazi
(74) *Attorney, Agent, or Firm* — Harness, Dickey & Pierce, P.L.C.

(57) ABSTRACT

A fuel injector rail for supplying fuel to at least one fuel injector. The fuel injector rail includes a delivery pipe, an injector port, and a flow director. The delivery pipe defines a fuel passage therein. The delivery pipe defines an injector port that fluidly that couples the fuel passage to the at least one fuel injector. The flow director is located in the fuel passage at a surface opposite to the injector port. The flow director guides a flow of fuel to the injector port.

12 Claims, 5 Drawing Sheets

FUEL INJECTOR RAIL

FIELD

The present disclosure relates to a fuel injector rail.

BACKGROUND

This section provides background information related to the present disclosure which is not necessarily prior art.

A typical vehicle combustion engine includes a plurality of fuel injectors, each of which sprays pressurized fuel from a fuel injector rail into a cylinder head of the engine. Each fuel injector may be connected to the fuel injector rail with a fuel cup. The fuel cup includes a column that defines an aperture extending therethrough and receives fuel from the fuel injector rail through the aperture. In order to store an adequate volume of fuel so as to meet the demand of the fuel injectors, the fuel is pumped by a high-pressure fuel pump. However, the high-pressured fuel may cause vibration and/or noise due to pumping pulsations from the high-pressure fuel pump and/or opening/closing of each individual fuel injector. There is more room to enhance performance and/or efficiency of the engine by directing the flow of the fuel in the fuel injector rail into the fuel injectors.

SUMMARY

This section provides a general summary of the disclosure, and is not a comprehensive disclosure of its full scope or all of its features.

The present teachings provide for a fuel injector rail for supplying fuel to at least one fuel injector. The fuel injector rail includes a delivery pipe, an injector port, and a flow director. The delivery pipe defines a fuel passage therein. The delivery pipe defines an injector port that fluidly couples the fuel passage to the at least one fuel injector. The flow director is located in the fuel passage at a surface opposite to the injector port. The flow director guides a flow of fuel to the injector port.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
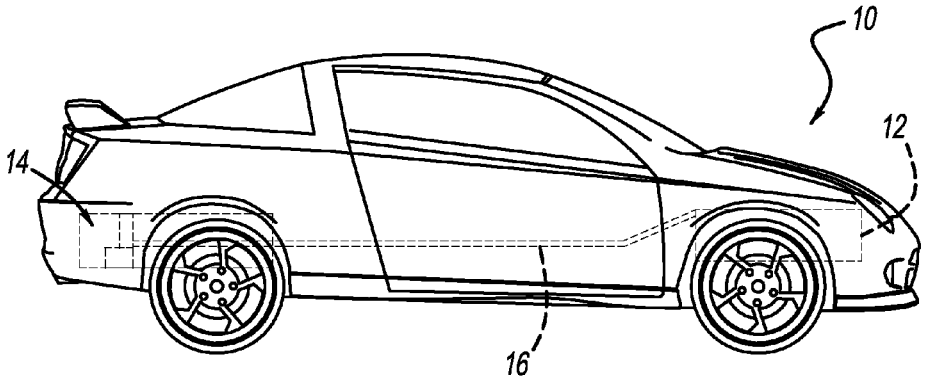
FIG. 1 is a side view of a vehicle including a fuel system according to the present teachings.
Figure 2:
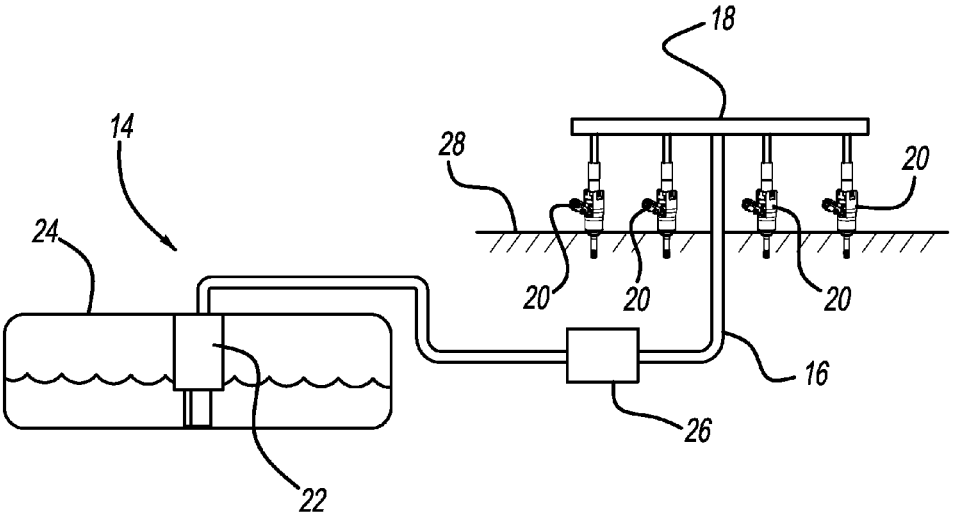
FIG. 2 is a schematic drawing depicting fuel injector mounting assemblies of the fuel system.

With initial reference to FIGS. 1 and 2, a vehicle 10, such as an automobile, that includes an internal combustion engine 12 that receives fuel from a fuel supply system 14 is illustrated. The fuel supply system 14 generally includes a fuel supply line 16, a common rail or fuel injector rail 18, and a plurality of fuel injectors 20. The fuel injectors 20 are connected to the fuel injector rail 18. A fuel pump module 22 may be mounted within a fuel tank 24 and submerged in or surrounded by varying amounts of liquid fuel within the fuel tank 24 when the fuel tank 24 contains liquid fuel. An electric fuel pump included with the fuel pump module 22 pumps fuel from the fuel tank 24 to a direct injection fuel pump 26, which is a high-pressure pump, through fuel supply line 16. The fuel supply line 16 carries fuel from the fuel tank 24 to the fuel injector rail 18. During operation of the engine 12, fuel passes from the fuel injector rail 18 into the fuel injectors 20 and is subsequently sprayed into the engine 12 through an intake manifold or a cylinder head 28 and into a combustion cylinder for combustion.

Figure 3:
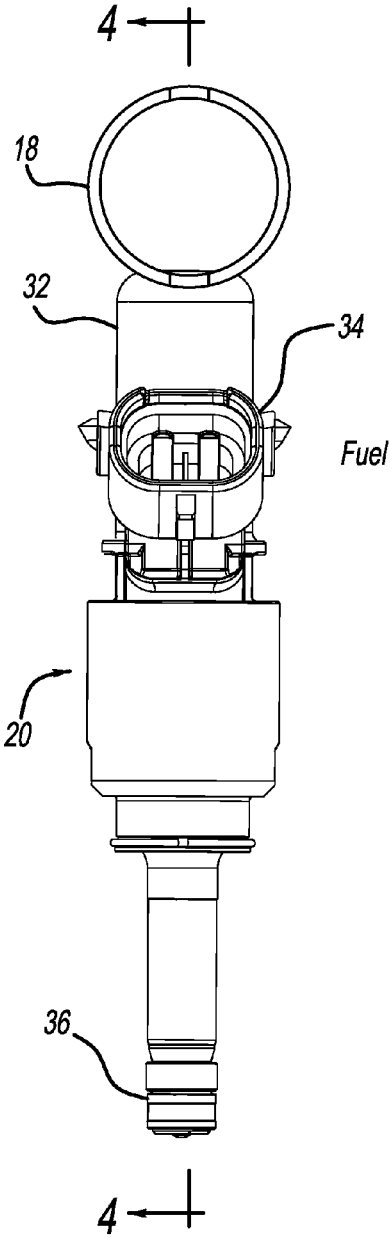
FIG. 3 is a side view of a fuel injector with a fuel cup attached to a fuel injector rail in a first embodiment.

FIG. 3 is a side view of the fuel injector 20 including a fuel cup 32 attached (e.g. brazed) to a first embodiment of the fuel injector rail 18. The fuel injector 20 includes an electrical plug 34 that electrically connects with a vehicle wiring harness interfaces with the fuel injector 20. A fuel injector exit tip 36 of the fuel injector 20 may be placed directly into an engine combustion chamber.

Figure 4:
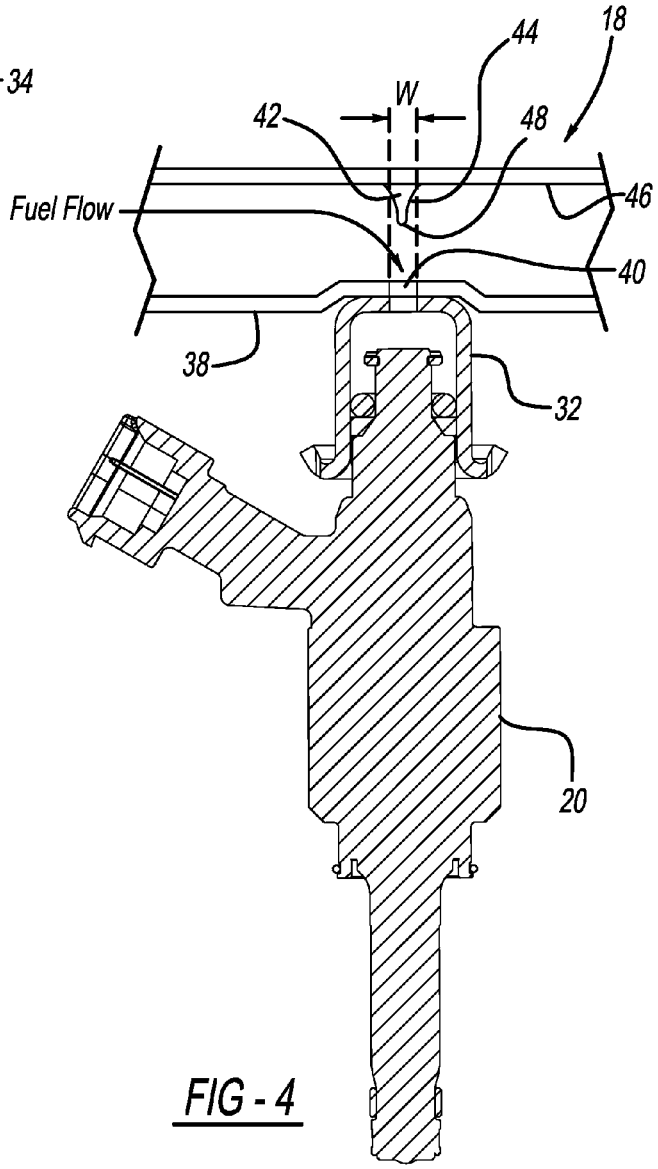
FIG. 4 is a cross sectional view of the fuel injector attached to the fuel injector rail having a flow director in the first embodiment.

With reference to FIG. 4, a cross sectional view of the fuel injector rail 18 and the fuel injector 20 are illustrated. The fuel injector rail 18 includes a delivery pipe 38 having a cylindrical shape. The delivery pipe 38 defines a fuel passage therein and includes an injector port 40 and a flow director 42. The injector port 40 is defined as a small hole by the delivery pipe 38. The fuel supplied through the fuel passage of the delivery pipe 38 enters the fuel cup 32 by way of the injector port 40. Fuel is preserved in the fuel cup 32 temporary and then sent to the fuel injector 20.

The flow director 42 is formed in a conical shape with a curved profile 44 and protrudes from an inner wall 46 of the delivery pipe 38 toward the injector port 40. A tip portion 48 of the flow director 42 may be arranged within a width W corresponding to the diameter of the injector port 40. One or more injector ports 40 and one or more flow directors 42 may be formed along the delivery pipe 38 depending on the number of the fuel injector 20 or the cylinder head 28.

Figure 5:
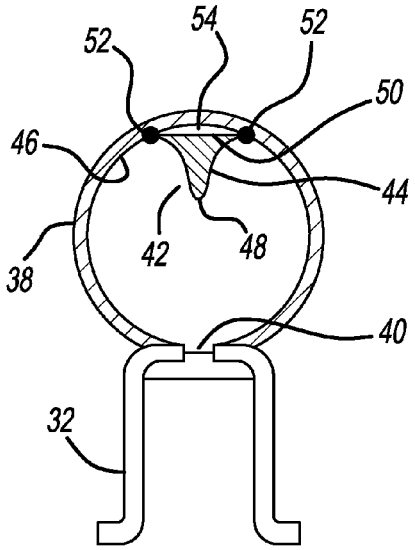
FIG. 5 is a cross sectional view of the fuel injector rail having the flow director in the first embodiment.

With reference to FIG. 5, the flow director 42 has a flat bottom 50 which is spot welded to the inner wall 46 of the delivery pipe 38 by welds 52. In this case, a gap 54 is defined between the inner wall 46 of the delivery pipe 38 and the flat bottom 50 of the flow director 42.

In the first embodiment, the fuel pumped by the direct injection fuel pump 26 flows along the fuel passage defined in the delivery pipe 38. Some of the fuel is guided by the flow director 42 and directed into the injector port 40. In other words, the flow director 42 changes the flow of the fuel to bias the flow towards the injector port 40. As a result, pumping pulsations caused by the high-pressurized fuel from the direct injection fuel pump 26 and/or openings/closing of each individual fuel injector 20 is dissipated and thus the performance and/or efficiency of the engine may be enhanced compared to use of the delivery pipe 38 with a simple round tube.

Figure 6:
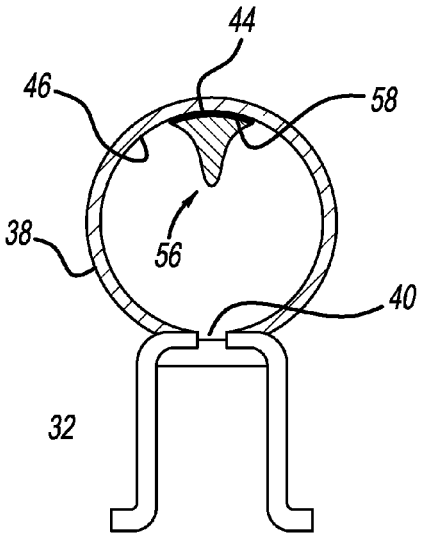
FIG. 6 is a cross sectional view of the fuel injector rail having a flow director in a second embodiment.
Figure 7:
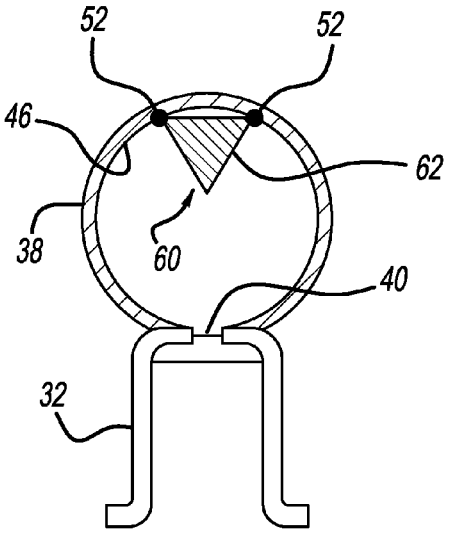
FIG. 7 is a cross sectional view of the fuel injector rail having a flow director in a third embodiment.
Figure 8:
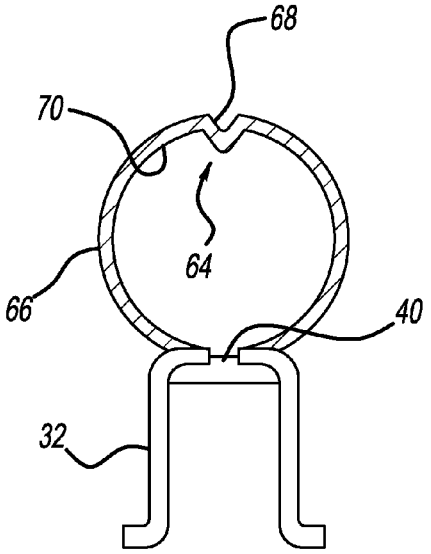
FIG. 8 is a cross sectional view of the fuel injector rail having a flow director in a forth embodiment.

The flow director 42 may be formed in a variety shapes. For example, FIG. 6 illustrates a second embodiment of a flow director 56. The flow director 56 may have a curved bottom 58. Unlike the flow director 42, there is no gap between the inner wall 46 of the delivery pipe 38 and the curved bottom 58 of the flow director 56. FIG. 7 illustrates a third embodiment of a flow director 60. The flow director 60 also may be formed in conical shape with a straight profile 62. Furthermore, FIG. 8 illustrates a fourth embodiment of a flow director 64. The flow director 64 is a part of a delivery pipe 66. For example, an outer surface 68 of the delivery pipe 66 may be punched press (e.g. dimpled) to form the flow director 64 along an inner surface 70 of the delivery pipe 66.

A fifth embodiment and a sixth embodiment illustrates other configuration between the delivery pipe and the fuel cup.

Figure 9:
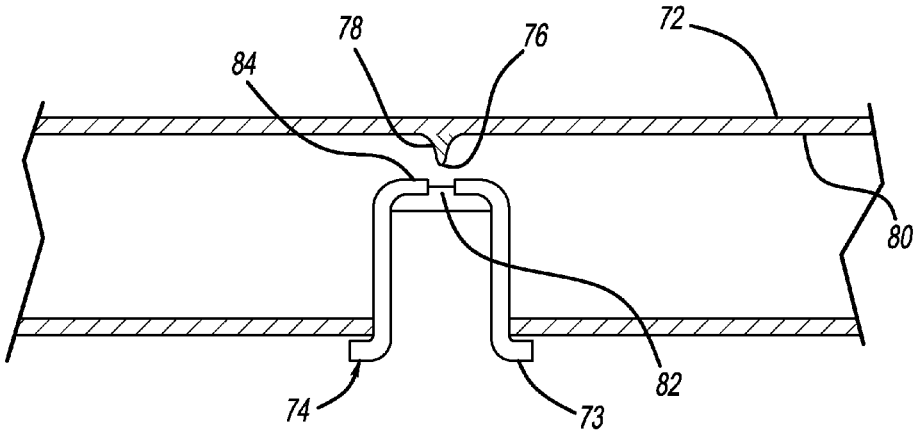
FIG. 9 is a cross sectional view of a fuel injector rail in a fifth embodiment.
Figure 10:
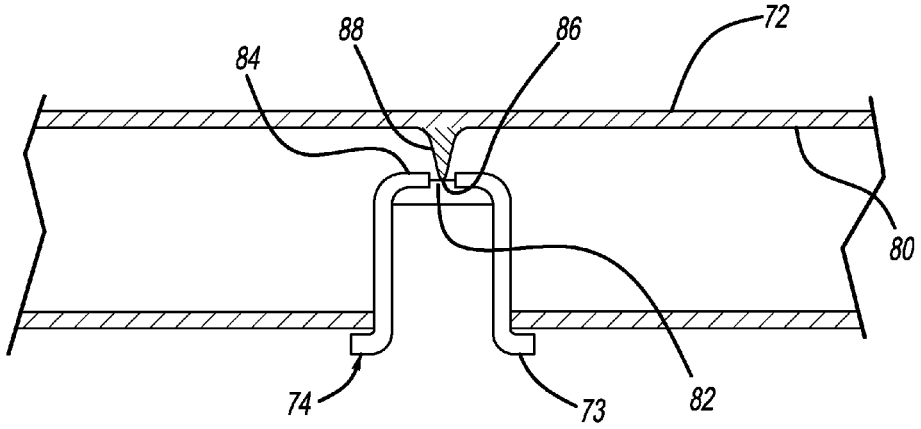
FIG. 10 is a cross sectional view of a fuel injector rail in a sixth embodiment.

FIG. 9 is a cross sectional view of the fuel injector rail 18 in the fifth embodiment. The difference between the first embodiment and the fifth embodiment is that a fuel cup 74 is partially installed inside a delivery pipe 72 instead of being attached to the delivery pipe 72. The delivery pipe 72 defines a hole and the fuel cup 74 is disposed in the hole. A rim 73 of the fuel cup 74 abuts with an outer surface of the delivery pipe 72. A tip 76 of a flow director 78 protrudes from an inner wall 80 of the delivery pipe 72 toward an injector port 82. The injector port 82 is defined at a top 84 of the fuel cup 74. FIG. 10 illustrates the fuel injector rail 18 having a flow director 88 in a sixth embodiment. A tip 86 of the flow director 88 may be arranged close to or overlapped with the injector port 82. Other details are the same as those in the first embodiment, which is omitted for the sake and brevity.

In the fifth and sixth embodiment, the distance between the tip 76, 86 and the injector port 88 are closer than that of the first embodiment. Thus, the flow of the fuel may be guided by the flow director 78, 88 and directed into the injector port 88 more efficiently.

Figure 11:
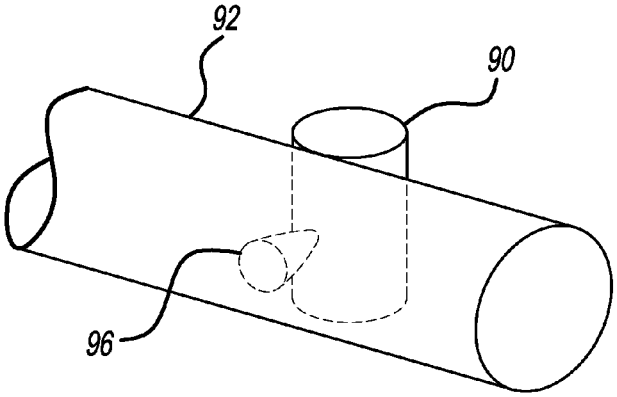
FIG. 11 is a perspective view of a fuel injector rail in a seventh embodiment.
Figure 12:
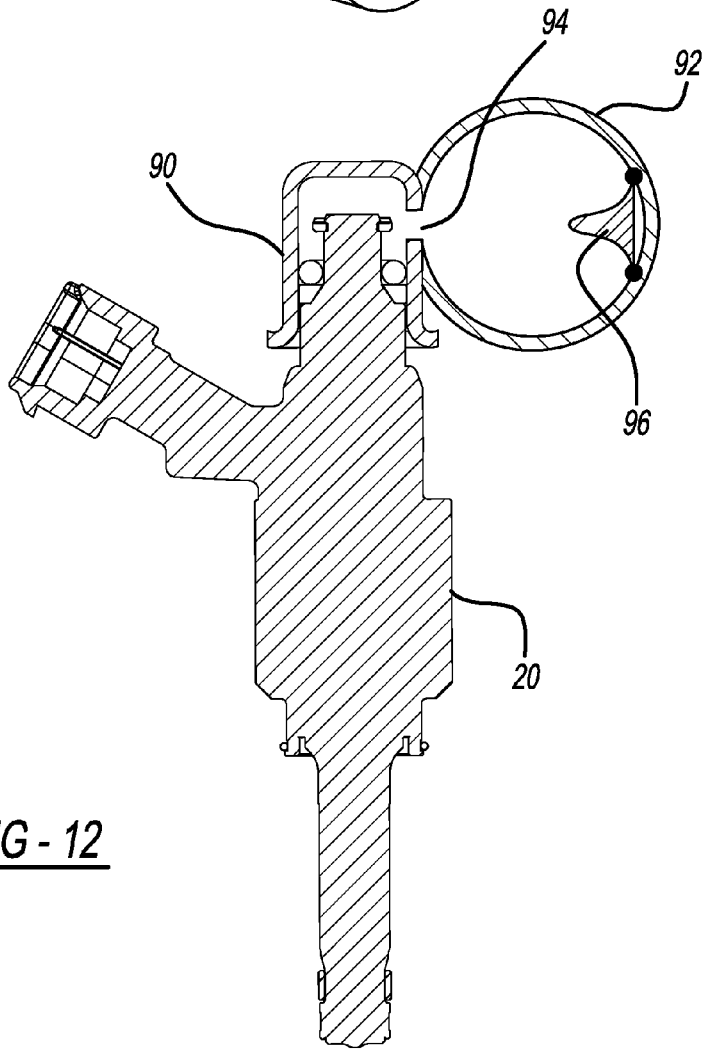
FIG. 12 is a cross sectional view of the fuel injector rail in the seventh embodiment shown in FIG. 11.

FIG. 11 is a perspective view of the fuel injector rail in a seventh embodiment. The difference from the other embodiments is that the cylindrical body of a fuel cup 90 is attached to a side of a delivery pipe 92 instead of being attached under the delivery pipe 92. As shown in FIG. 12, the delivery pipe 92 communicates with the fuel cup 90 through the injector port 94 defined by a side wall of the fuel cup 90. The flow director 96 protrudes from the inner wall of the delivery pipe 92 toward to the injector port 94. Other details are the same as those in the first embodiment, which is omitted for the sake and brevity.

Any of the flow directors 42, 56, 60 and 64 described with respect to the first to fourth embodiment shown in FIGS. 5-8 may be utilized in the delivery pipe and fuel cup arrangements shown in the fifth to seventh embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel injector rail for supplying fuel to at least one fuel injector, the fuel injector rail comprising:

a delivery pipe forming a fuel passage and defining an injector port that fluidly couples the fuel passage to the at least one fuel injector; and a flow director located in the fuel passage at a surface opposite to the injector port, wherein the flow director guides fuel to the injector port;

wherein:

the flow director protrudes from an inner wall of the delivery pipe toward the injector port;

the flow director terminates prior to reaching the injector port so as to not extend within the injector port; and the flow director has a conical shape with a tip opposite to the injector port.

2. The fuel injector rail of claim 1, wherein the tip of the flow director is arranged within a width corresponding to a diameter of the injector port.

3. The fuel injector rail of claim 1, wherein the flow director is formed in the conical shape with a curved profile.

4. The fuel injector rail of claim 1, wherein the flow director is formed in the conical shape with a straight profile.

5. The fuel injector rail of claim 1, wherein the flow director has a flat bottom that is spot welded to an inner wall of the delivery pipe such that a gap is defined between the flat bottom and the inner wall.

6. The fuel injector rail of claim 1, wherein the flow director has a curved bottom that is flush with and spot welded to an inner wall of the delivery pipe.

7. The fuel injector rail of claim 1, wherein the flow director is formed by the delivery pipe such that the delivery pipe is dimpled along an outer surface of the delivery pipe.

8. The fuel injector rail of claim 1, further comprising a fuel cup attached to the delivery pipe.

9. The fuel injector rail of claim 1, further comprising a fuel cup partially installed inside the delivery pipe.

10. The fuel injector rail of claim 1, wherein the tip of the flow director is arranged close to or overlapped with the injector port.

11. The fuel injector rail of claim 1, further comprising a fuel cup attached to a side of the delivery pipe, wherein the delivery pipe communicates with the fuel cup through the injector port bored through a side wall of the fuel cup.

12. The fuel injector rail of claim 1, wherein the delivery pipe is formed in a cylindrical shape.

* * * * *